United States Patent [19]

Gunther

[11] Patent Number: 4,606,246

[45] Date of Patent: Aug. 19, 1986

[54] SOCKET WRENCH COUPLER

[76] Inventor: John R. Gunther, 1880 Delann La, Salt Lake City, Utah 84121

[21] Appl. No.: 688,319

[22] Filed: Jan. 2, 1985

[51] Int. Cl.[4] ..... B25B 13/00

[52] U.S. Cl. ..... 81/58.3

[58] Field of Search ..... 81/58.3, 58.4

[56] References Cited

U.S. PATENT DOCUMENTS 1,521,331 12/1924 Sedgley ..... 81/58.3

2,667,801 2/1954 Eaves ..... 81/58.3

2,947,209 8/1960 Kostka ..... 81/58.3

*Primary Examiner*—James L. Jones, Jr.

[57] ABSTRACT

A socket wrench coupler that will hold a socket in place on an engaged bolt or screw head or nut during turning of the engaged member and during repositioning of a driving handle, and including first and second relatively movable housings arranged to rotate together in either direction as driven by handle means attached to one of the housings upon compression of spring means biasing the housings apart or to rotate separately upon expansion of the spring means.

1 Claim, 3 Drawing Figures

SOCKET WRENCH COUPLER

BACKGROUND OF THE INVENTION

1. Field of the Invention

This invention relates to socket tools and the connecting means to operate a variety of sockets or socket components.

2. Prior Art

Means for coupling sockets to drive mechanisms are well known. Many devices have been proposed in the past to hold and operate sockets. Such devices as are shown in U.S. Pat. No. 3,314,318 wherein a socket is coupled to a drive mechanism with a solid connecting bar. Another such device is shown in U.S. Pat. No. 3,289,503 wherein direct spring loaded drive mechanisms are provided for Allen screws. However these devices have the disadvantage, when operating in a direct drive mode, of not being able to maintain constant contact and pressure on the neck or bolt being driven during such time as the drive handle is repositioned with respect to the socket.

BRIEF DESCRIPTION OF THE INVENTION

Summary of the Invention

The present invention comprises a socket wrench coupler that provides a direct drive engagement between the socket and the drive handle, but allows the drive handle to be disengaged from the direct line mode with the socket and to be repositioned with respect to the socket while maintaining constant contact pressure with the nut or bolt being driven in socket.

OBJECTS OF THE INVENTION

A principal object of the present invention is to provide a means whereby a constant contact and pressure is made with a bolt being driven by a socket. Another object is to provide a means for protecting internal working components against dust, dirt, etc. that will make them inoperable.

FEATURES OF THE INVENTION

A principal feature of the invention is a direct arrangement that provides for a precise and responsive manipulation of a socket, in combination with means to effect release of the direct drive system as a handle is respositioned with respect to the socket while at the same time maintaining a constant pressure on nut or bolt being driven by the socket.

Other features of the invention include a cylindrical housing which has a changeable socket post protruding on one end and that is open to receive another smaller cylindrical housing contains recessed sockets on both ends. The end of the smaller cylindrical housing which slips into the larger cylindrical housing containing the changeable socket post has a recessed socket to slip fit or telescope over a hex head of the socket post. The slip fit or telescoped coupling becomes the connection means by which torque is transferred from the handle to the socket. The other end of the smaller cylindrical housing contains a recessed socket to receive a socket post of a handle.

The outer cylindrical surface of the smaller cylindrical housing contains a groove raceway that provides a means whereby both cylindrical housings are locked together with a wire keyway. With the wire keyway in position the distance that the smaller cylindrical housing can move inside the larger cylindrical housing is limited to the width of the groove raceway. Another feature is the use of a spring mounted between the two cylindrical housings to apply pressure and to keep the recessed socket end of the smaller cylindrical housing in a neutral position with respect to the hex head of the socket post. Pressure applied against the spring will move the recessed socket end over the hex head of the socket post so that the socket post can be driven.

Still another feature of the invention is that all internal working parts are positioned within the cylindrical housings, free from the grease and dirt which might hamper the operation of the components if not so protected.

Other objects and features of the invention will become apparent from the following detailed description and drawings, disclosing what is presently contemplated as being the best mode of the invention.

THE DRAWING

In the drawings:

FIG. 1, is a perspective, exploded view of the assembled socket wrench coupler and handle with a typical socket shown in position to be mounted on the coupler;

FIG. 2, a cross section view of the socket wrench coupler, taken on the line 2—2 of FIG. 1;

FIG. 3, an exploded perspective view of the socket wrench coupler and handle.

DETAILED DESCRIPTION OF THE INVENTION

Figure 1:
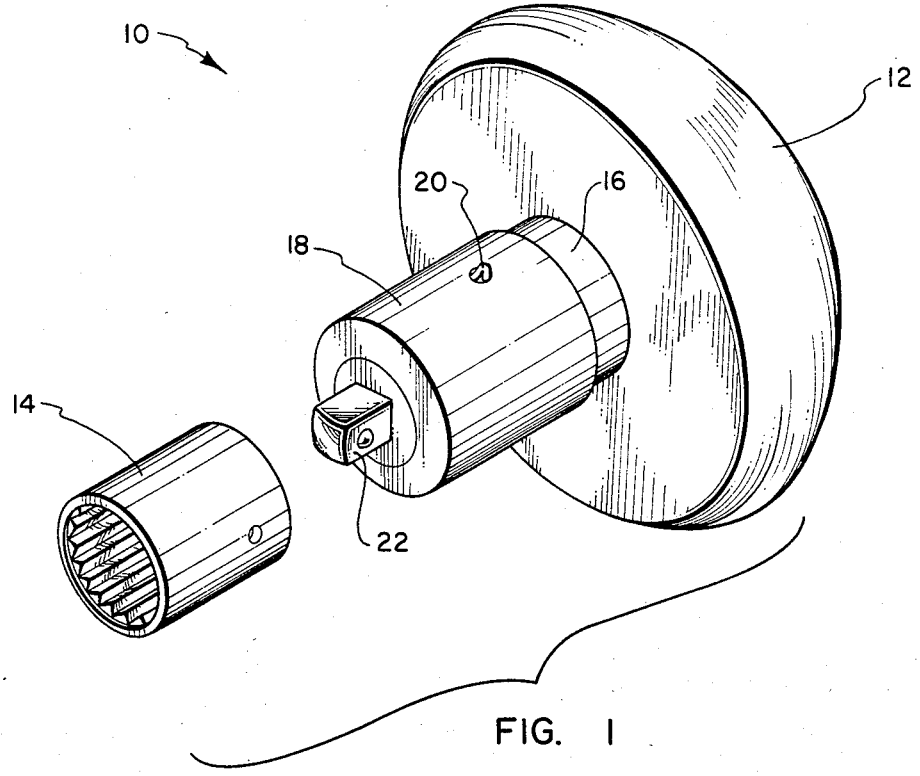

Referring now to the drawings:

In the illustrated preferred embodiment, the sprocket wrench coupler of the invention is shown generally at 10. The handle, used to operate the coupler 10, is shown generally at 12 and a typical socket 14 is shown in position to be telescoped onto a post end of the socket wrench coupler 10.

Figure 2:
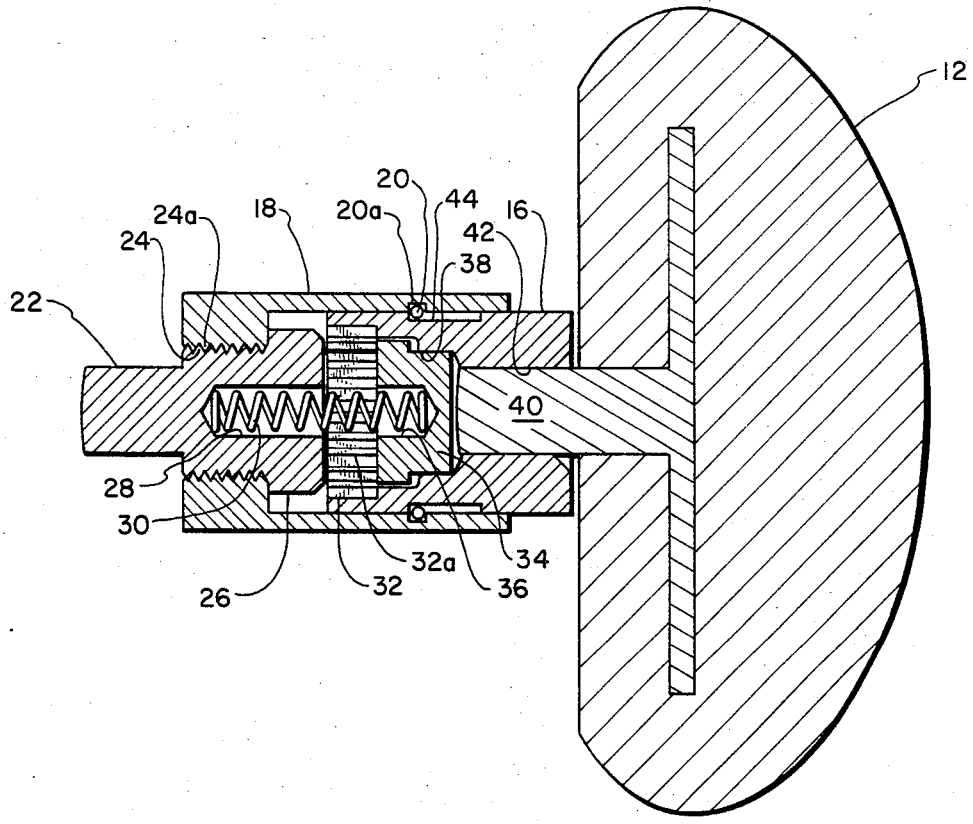
Figure 3:
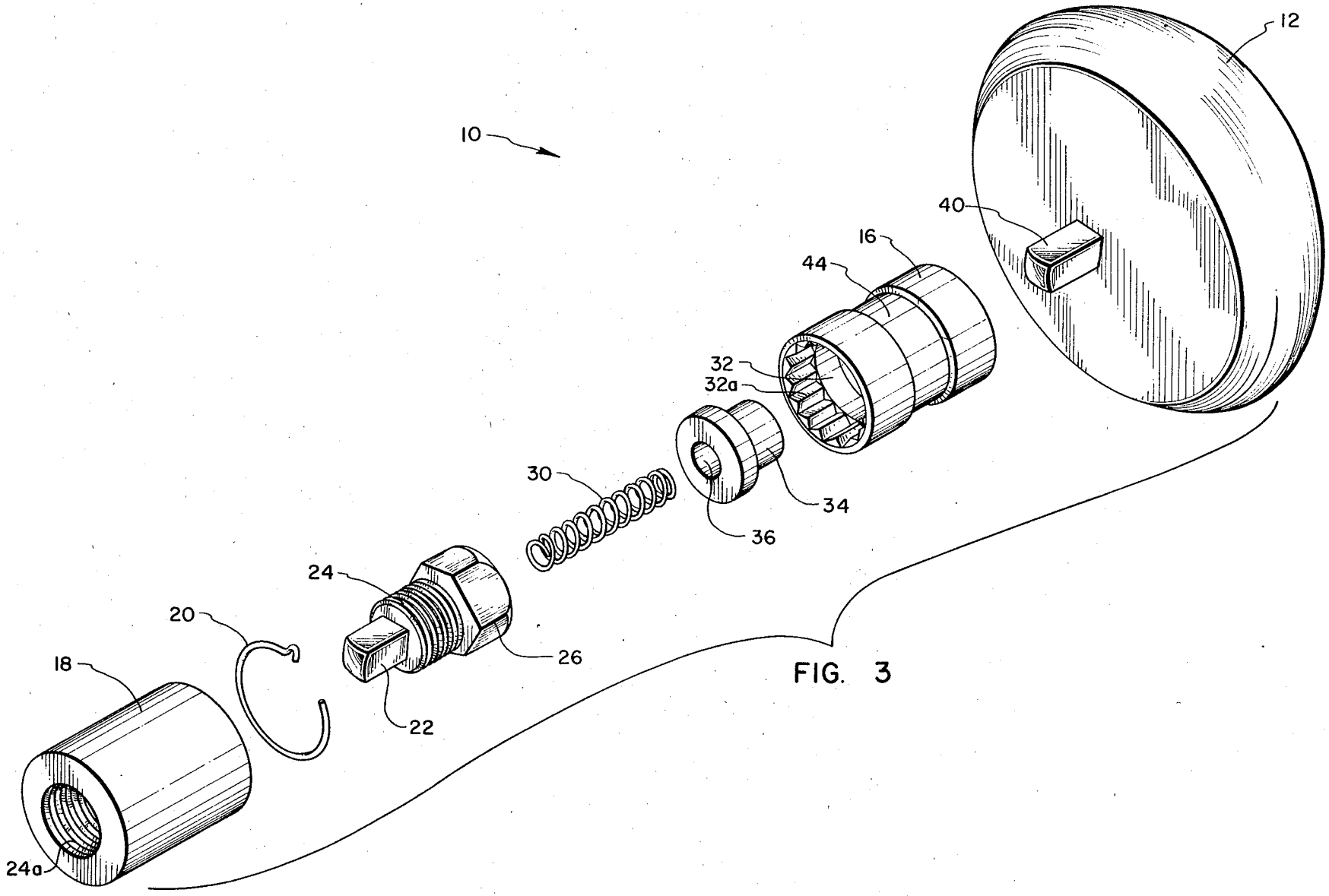

The socket wrench coupler includes a smaller cylindrical housing 16, which telescopes into a larger cylindrical housing 18. The two cylindrical housings are locked together by a spring wire 20 that fits into a keyway **20*a* formed inside housing 18. A changeable socket post fitting 22 projects from one end of cylindrical housing 18 to receive sockets of varying sizes. As shown best in FIG. 2, the socket post fitting 22 is connected to the larger cylindrical housing by means of matching threads 24 on the socket post fitting and 24*a* in the housing 18**. It will be apparent that a variety of fittings having differently sized socket posts can be provided. Thus, sockets fitting or any conventional post size, i.e. $\frac{1}{4}''$, $\frac{3}{8}''$ or $\frac{1}{2}''$ can be accomodated.

The post fitting 22 has a hexagonal head end 26 with a counterbore 28 therein into which one end of a spring 30 is positioned. Spring 30 is compressed between the small and large cylindrical housings 16 and 18, respectively, and acts to bias the two housings to a neutral position, as will be further described. Small cylindrical housing 16 has a large bore 32 formed in an interior end thereof and teeth **32*a* are formed on the inside wall of the large bore. The bore fits over the hexagonal head end 26 of socket post fitting 22 and the teeth engage the corners of the hexagonal head and when the housing 16 is telescoped over the head end 26. The engagement of the teeth 32*a* against the corners of the hexagonal head 26 locks the two cylinder housings together for rotation, and provides for a positive and direct drive through the coupler and between the handle 12 and the socket 14. A plug 34, has a bore 36 to receive the other end of spring 30. Plug 34 is tightly pressed into a counterbore 38 of small housing 16 and the expansion of spring 30 against the ends of bores 28 and 38, respectfully, keeps the small and large cylindrical housings separated and in a neutral position, wherein teeth 32***a* are out of engagement with the corners of head end 22 and it is possible to rotate each of the cylindrical housings individually without simultaneously rotating the other cylinder housing. When a sprocket 14 is attached to post fitting 22 the spring acts to maintain a positive pressure on the sprocket 14 which contains the nut or bolt being driven through the sprocket even while the handle 12 is turned or repositioned to a new orientation. The socket will be held on the nut or screw while the coupler is in the neutral position.

The handle 12 has a projecting socket post 40 that fits tightly into a post socket hole 42 located in the other end of small cylindrical housing 16. Pressure applied to handle 12 compresses spring 30 and moves the small cylindrical housing 16 inside the larger housing 18 until the small housing telescopes onto head end 26 and the teeth 32*a* engages the corners of the head end. Rotation of the handle 12 in either direction is then transmitted through post 40, small cylindrical housing 16, teeth 32*a* and the corners of the hexagonal head and 26, and post 22 to the socket 14 and any nut or bolt head over which the socket is placed in driving engagement. When it is desirable to reorient the handle to a more favorable position the pressure applied to compress spring 30 is released and the handle, as well as the smaller cylinder housing is pushed outward from the larger cylindrical housing to again separate teeth 32*a* from the corners of head end 26. The distance the cylinder housings can move relative to one another is limited by the width of a wire keyway 44 that is formed inside housing 16. Wire 20, positioned keyway in 20*a* also extends into keyway 44. Thus, movement of the housing 16 relative to housing 18, and vice versa, is limited by engagement of the ends of keyway 44 with the wire.

It will be apparent that handle 12, here shown as being somewhat hemispherical in configuration can have any desired shape.

In practice, it is preferred that all components be formed from high grade steel and that close tolerances be used between parts.

Although a preferred form of my invention has been herein disclosed it is to be understood that the present disclosure is by way of example and that variations are possible without departing from the subject matter coming within the scope of the following claims, which subject matter I regard as my invention.

I claim:

1. A socket wrench coupler comprising a first housing a second housing, said first and second housing being mounted to reciprocate and to rotate with respect to one another;

handle means connected to the first said housing and rotatable therewith;

a socket post fitting fixed to, projecting from and extending into the second housing and having a blind base extending centrally thereinto to receive one end of a spring;

means limiting the extent of reciprocation of the housings relative to one another, said means comprising a narrow groove in the inside wall of the second housing, a snap ring in the narrow groove and extending outwardly thereof; and a wide groove in an outer wall in the first housing to receive the snap ring;

teeth means on an inner wall of the first housing;

a plug positioned in the first housing adjacent the teeth means, corner means on the socket post fitting inside the second housing arranged to be surrounded and engaged by the teeth means of the first housing whereby rotation of the first housing will rotate the second housing; and a spring having one end in the blind bore of the socket post fitting and the other end thereof in a blind bore formed in the plug, said spring biasing the housings apart, whereby the teeth means are out of engagement with the corner means and the handle and first housing will rotate together independently of the second housing.

* * * * *